US009357281B2

(12) United States Patent
Aoyagi et al.

(10) Patent No.: US 9,357,281 B2
(45) Date of Patent: May 31, 2016

(54) RECEIVER

(71) Applicant: Molex, LLC, Lisle, IL (US)

(72) Inventors: Yoshimi Aoyagi, Yamato (JP); Tomonari Kaneko, Ebina (JP); Atsuhito Horino, Ebina (JP)

(73) Assignee: Molex, LLC, Lisle, IL (US)

( * ) Notice: Subject to any disclaimer, the term of this patent is extended or adjusted under 35 U.S.C. 154(b) by 34 days.

(21) Appl. No.: 14/510,453

(22) Filed: Oct. 9, 2014

(65) Prior Publication Data

US 2015/0104035 A1 Apr. 16, 2015

(30) Foreign Application Priority Data

Oct. 10, 2013 (JP) ..... 2013-212450

(51) Int. Cl.
*H04R 1/06* (2006.01)
*H04R 1/10* (2006.01)

(52) U.S. Cl.
CPC ..... *H04R 1/06* (2013.01); *H04R 1/1033* (2013.01); *H04R 1/10* (2013.01)

(58) Field of Classification Search
None
See application file for complete search history.

(56) References Cited

U.S. PATENT DOCUMENTS

2008/0152163 A1* 6/2008 Mulvey ..... H04R 1/1016 381/74
2012/0093332 A1* 4/2012 Lin ..... H04R 1/1091 381/71.6
2013/0036597 A1* 2/2013 Parng ..... H04R 1/10 29/453
2013/0170692 A1* 7/2013 Kaneko ..... H04R 1/1033 381/380
2015/0104035 A1* 4/2015 Aoyagi ..... H04R 1/06 381/74

FOREIGN PATENT DOCUMENTS

JP 2011-234124 A 11/2011

* cited by examiner

*Primary Examiner* — Peter Vincent Agustin
(74) *Attorney, Agent, or Firm* — James A. O'Malley

(57) ABSTRACT

A receiver is provided with a connector including: an outer earbud contact composed of a tube-shaped conductor and provided on the earbud side, an inner earbud contact arranged inside the outer earbud contact via an earbud-side insulator, an outer cable contact composed of a tube-shaped conductor and provided on the cable side, and an inner cable contact arranged inside the outer cable contact via a cable-side insulator; a coaxial connector being formed when the outer contacts are screwed into each other.

8 Claims, 12 Drawing Sheets

RECEIVER

REFERENCE TO RELATED APPLICATIONS

The Present Disclosure claims priority to prior-filed Japanese Patent Application No. 2013-212450, entitled "Receiver," filed on 10 Oct. 2013 with the Japanese Intellectual Property Office. The content of the aforementioned Patent Application is incorporated in its entirety herein.

BACKGROUND OF THE PRESENT DISCLOSURE

The Present Disclosure relates, generally, to a receiver using a connector connected to a cable and to the main body of a receiver such as an earphone or headphones, and, more particularly, to a receiver having a connector connected electrically to an earbud and to a cable, which prevents unintentional disconnection, realizes a robust connection between contacts, and prevents momentary power interruptions during use without requiring a separate retaining portion.

In a conventional receiver such as an earphone or headphones, an earbud housing a driver unit is integrally connected to a cable. As a result, both the earbud and the cable have to be replaced when a problem such as disconnection occurs in the cable. This increases the cost burden of the user.

An earphone has been proposed, for example, in Japanese Patent Application No. 2010-102516, the content of which is hereby incorporated herein in its entirety, with a detachable and replaceable cable. This cable is connected to the earbud via a plugin connector. However, because plugin connectors have very little retention force, the cable easily becomes disconnected when pulled during use.

In the earphone described in the '516 Application, a retaining portion (first engagement structure) is added on both the earbud side and the cable side. When the cable is connected to the earbud, the cable engages the retaining portions on the earbud side and the cable side and is retained. However, the addition of the retaining portions causes new problems. The connecting portions are larger on the earbud side and the cable side, and the structure becomes more complicated.

SUMMARY OF THE PRESENT DISCLOSURE

In view of this problem, it is an object of the Present Disclosure to provide a receiver having a connector connected electrically to an earbud and to a cable, which prevents unintentional disconnection, realizes a robust connection between contacts, and prevents momentary power interruptions during use without requiring a separate retaining portion.

In order to achieve this object, the Present Disclosure is a receiver having a connector connected electrically to a receiver main body and to a cable. The connector comprises an outer main body contact, an inner main body contact, an outer cable contact and an inner cable contact. The outer main body contact is composed of a tube-shaped conductor and provided on the main body side. The inner main body contact is arranged inside the outer main body contact via an insulator. The outer cable contact is composed of a tube-shaped conductor and provided on the cable side. The inner cable contact is arranged inside the outer cable contact via an insulator. The connector is mounted on the receiver main body so that, in response to the outer main body contact and outer cable contact being mated, a coaxial connector is formed electrically connecting the outer contacts and the inner contacts, the outer contacts being screwed into each other, and the outer main body contact not rotating relative to the receiver main body.

The Present Disclosure is able to provide a receiver having a connector connected electrically to an earbud and to a cable, which prevents unintentional disconnection, realizes a robust connection between contacts, and prevents momentary power interruptions during use without requiring a separate retaining portion.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
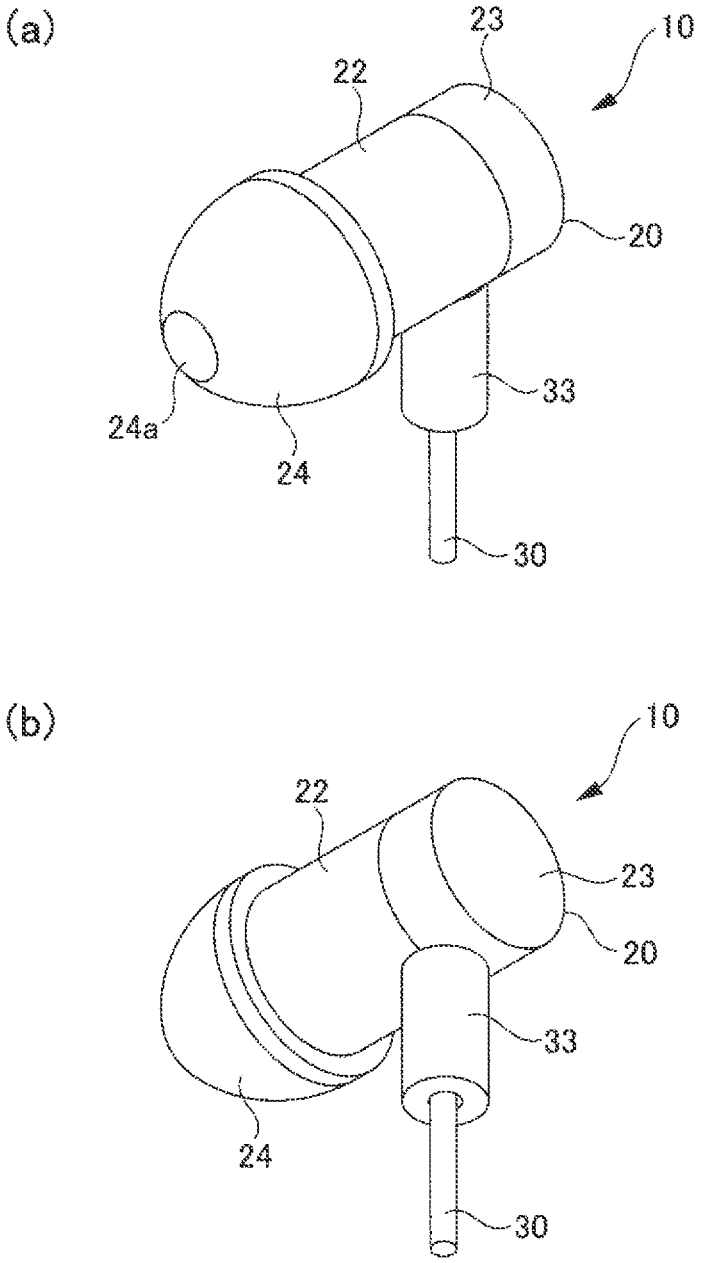
FIG. 1 is a diagram showing the earphone of the receiver in a first embodiment of the Present Disclosure connected to a cable, in which FIG. 1(*a*) is a front perspective view of the earphone, and FIG. 1(*b*) is a rear perspective view of the earphone.
Figure 2:
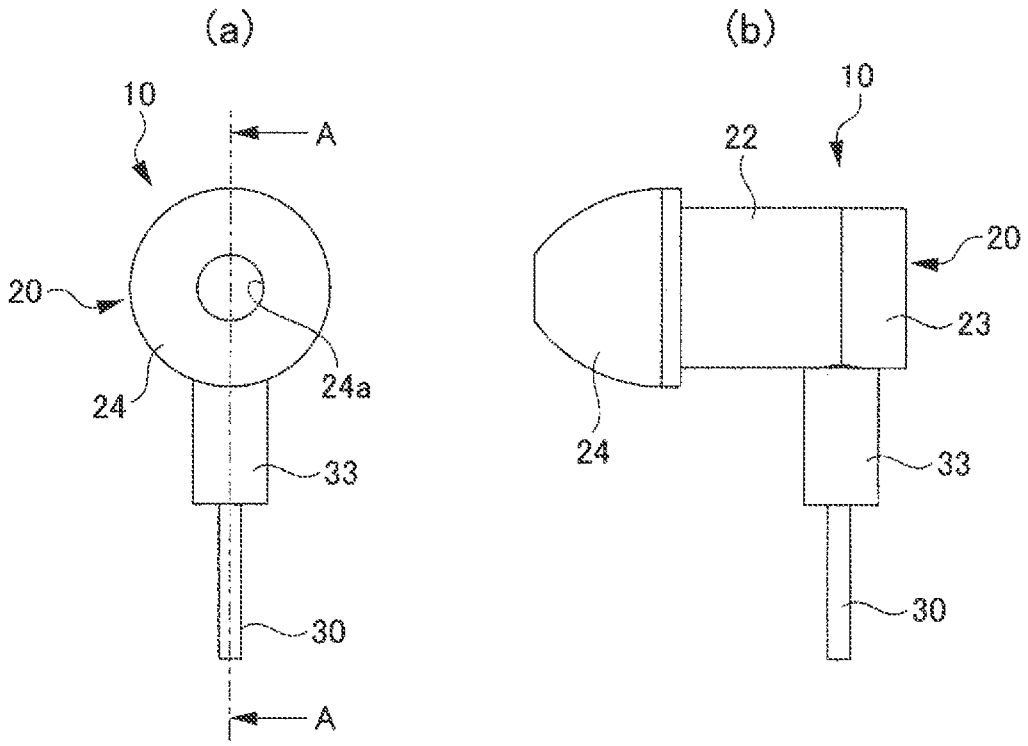
FIG. 2 is a diagram showing the earphone of the receiver in the first embodiment of the Present Disclosure connected to a cable, in which FIG. 2(*a*) is a front view of the earphone, and FIG. 2(*b*) is a side view of the earphone.
Figure 3:
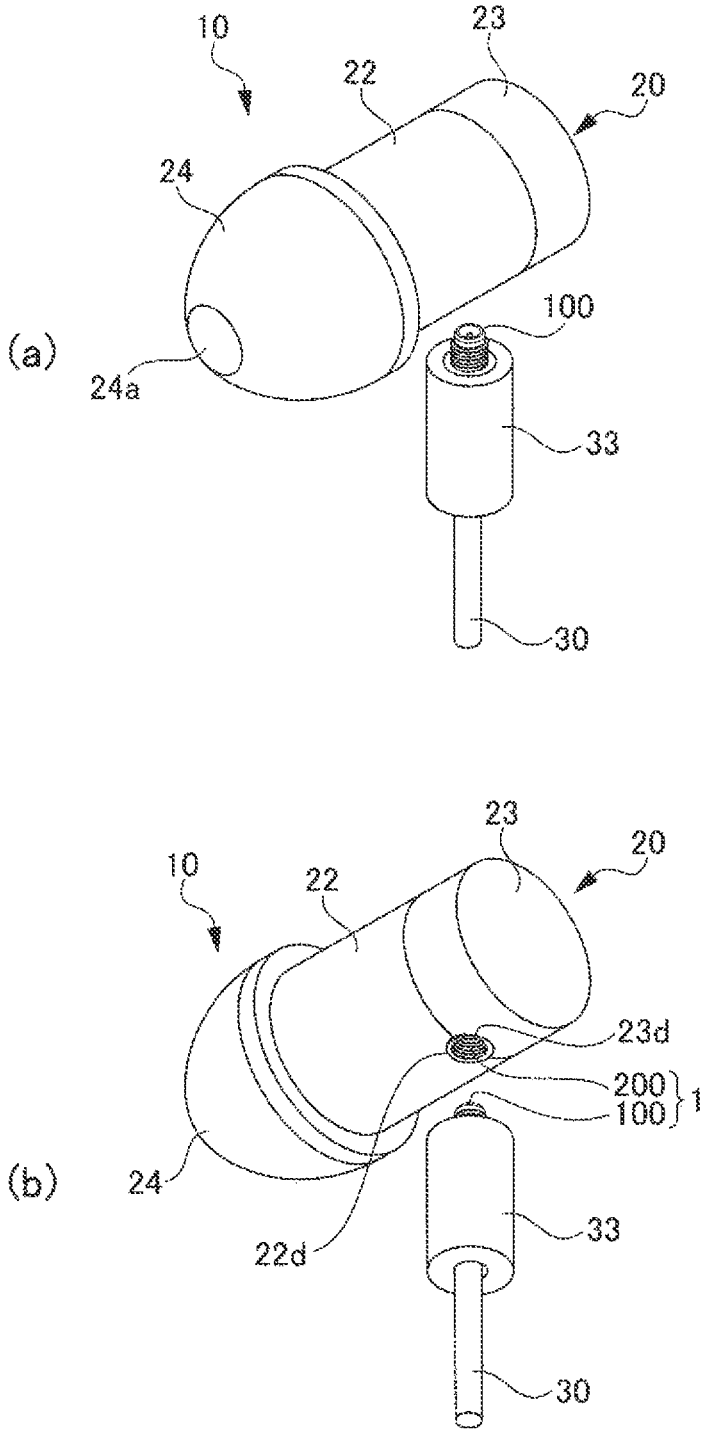
FIG. 3 is a diagram showing the earphone of the receiver in the first embodiment of the Present Disclosure detached from the cable, in which FIG. 3(*a*) is a front perspective view of the earphone, and FIG. 3(*b*) is a rear perspective view of the earphone.
Figure 4:
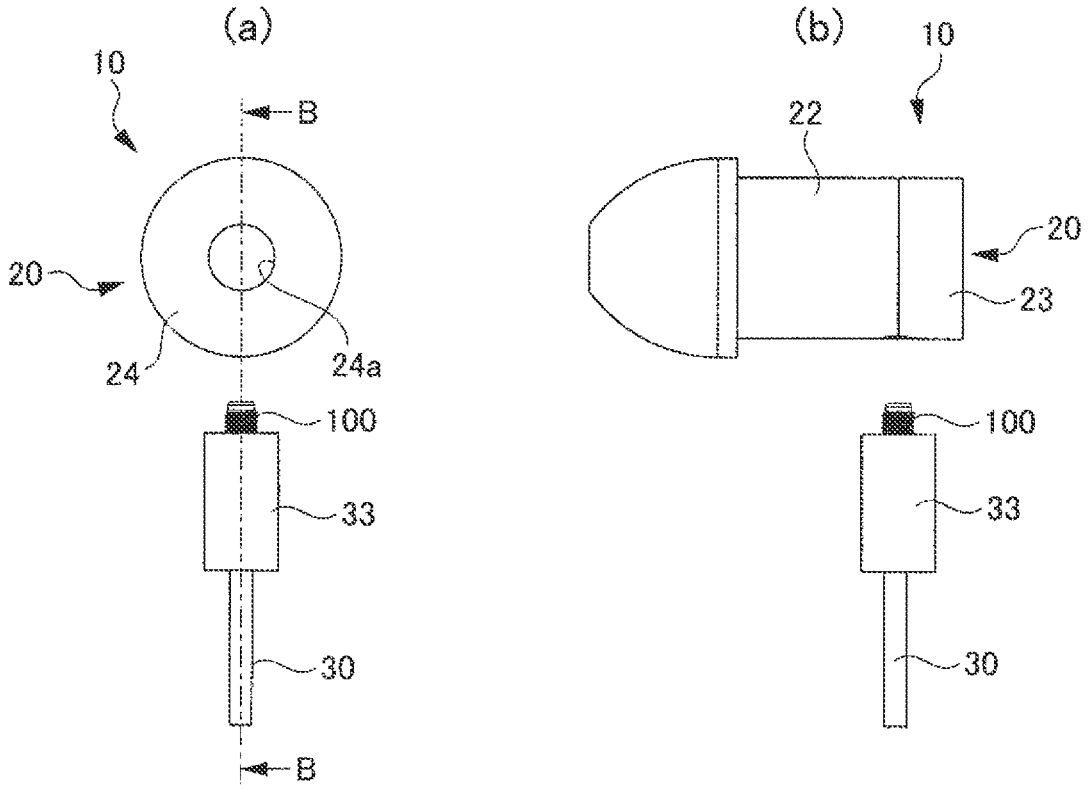
FIG. 4 is a diagram showing the earphone of the receiver in the first embodiment of the Present Disclosure detached from the cable, in which FIG. 4(*a*) is a front view of the earphone, and FIG. 4(*b*) is a side view of the earphone.
Figure 5:
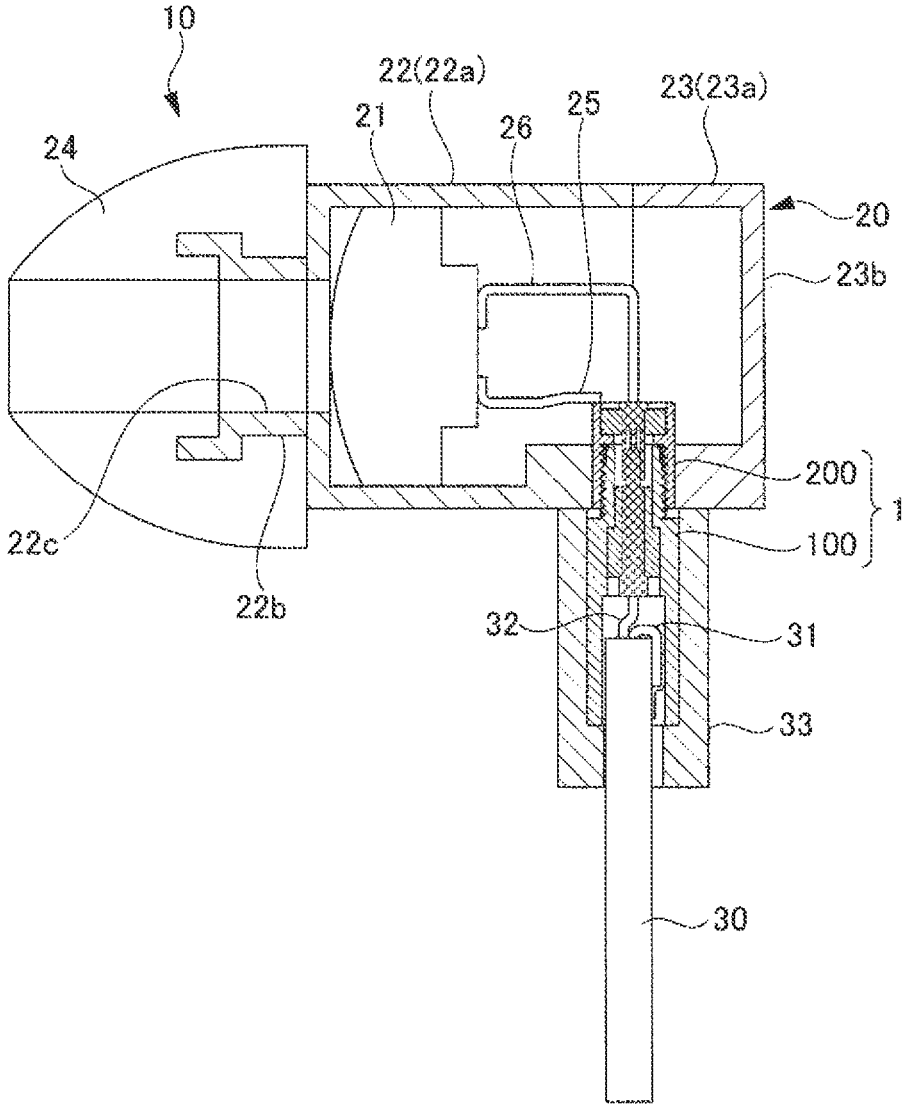
FIG. 5 is a cross-sectional view showing the earphone of the receiver in the first embodiment of the Present Disclosure connected to a cable, taken from Line A-A using a non-soldered connector.
Figure 6:
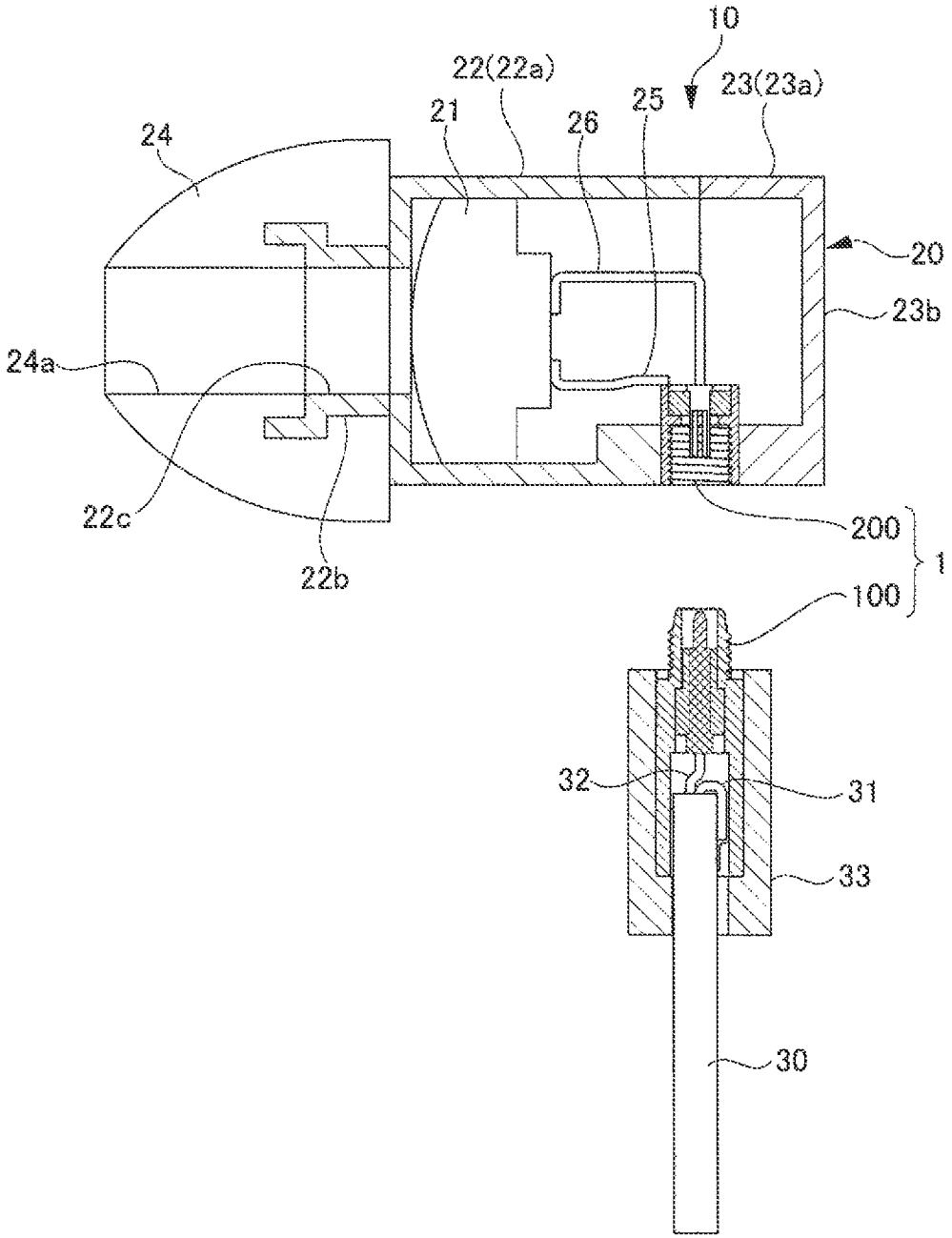
FIG. 6 is a cross-sectional view showing the earphone of the receiver in the first embodiment of the Present Disclosure detached from the cable, taken from Line B-B using a non-soldered connector.

As shown in FIGS. 1-2, the earphone 10 includes an earbud 20 fitted into the user's ear, and a cable 30 connected to the earbud 20 on one end. The cable 30 is connected on the other end to an audio device such as a music player, television, or radio (not shown) via a connector (not shown), and electrical signals outputted from the audio device are inputted to the earbud 20. The earbud 20 converts the electrical signals inputted from the cable 30 into sound, and outputs the sound. As shown in FIGS. 3-4, the earbud 20 and the cable 30 are connected electrically via a connector 1. The connector 1 includes and is composed of a cable connector 100 provided on the cable 30 side, and an earbud connector 200 provided on the earbud 20 side. When the cable connector 100 and the earbud connector 200 are mated, the cable 30 is connected to the earbud 20. When the cable connector 100 and the earbud connector 200 are unmated, the cable 30 is disconnected from the earbud 20. When a problem such as disconnection occurs in the cable 30, the cable 30 is simply replaced. As shown in FIGS. 5-6, the earbud 20 includes a driver unit 21 for converting electrical signals to sound, a front casing 22 and rear casing 23 for housing the driver unit 21, and an ear pad 24 inserted into the user's ear.

The front casing 22 includes a large-diameter tube portion 22*a* for housing the driver unit 21, and small-diameter tube portion 22*b* protruding forward from the large-diameter tube portion 22*a* and having the ear pad 24 applied to its outer periphery. The tube portions are integrally formed. An acoustic guide opening 22*c* is formed in the front end portion of the small-diameter portion 22*b*. The sound generated by the driver unit 21 is outputted from this, and the outputted sound propagates inside the user's ear via an acoustic guide hole 24*a* in the ear pad 24.

The rear casing 23 includes a large-diameter tube portion 23*a* connected to the large-diameter portion 22*a* of the front casing 22, and a lid portion 23*b* covering the rear end of the large-diameter portion 23*a*. These components are integrally formed. Semi-circular recessed portions 22*d*, 23*d* are formed in the abutting surfaces of the front casing 22 and the rear casing 23, and the earbud connector 200 is incorporated into the round hole formed by the abutting recessed portions 22*d*, 23*d*. The earbud connector 200 is connected electrically to the driver unit 21 via a pair of conductive wires 25, 26. The earbud connector 200 and the rear casing 23 are, for example, forcibly connected and secured using an adhesive so that the earbud connector 200 does not rotate with respect to the rear casing 23. The recessed portions 22*d*, 23*d* may be rectangular instead of semi-circular, and the external shape of the earbud connector 200 may be rectangular to prevent rotation. In this way, the connector 1 can be screwed in while preventing the earbud connector 200 from rotating with respect to the rear casing 23.

As shown in FIGS. 5-6, a cable connector 100 is provided in the end portion of the cable 30. The cable connector 100 is connected electrically to a pair of conductive wires 31, 32 passing through the cable 30, and the section excluding the leading end portion is covered by a tube-shaped cover 33.

In the present embodiment, the cable connector 100 is a plug connector or male connector, and the earbud connector 200 is a receptacle connector or female connector. Alternatively, the cable connector 100 may be a receptacle connector, and the earbud connector 200 may be a plug connector.

Figure 7:
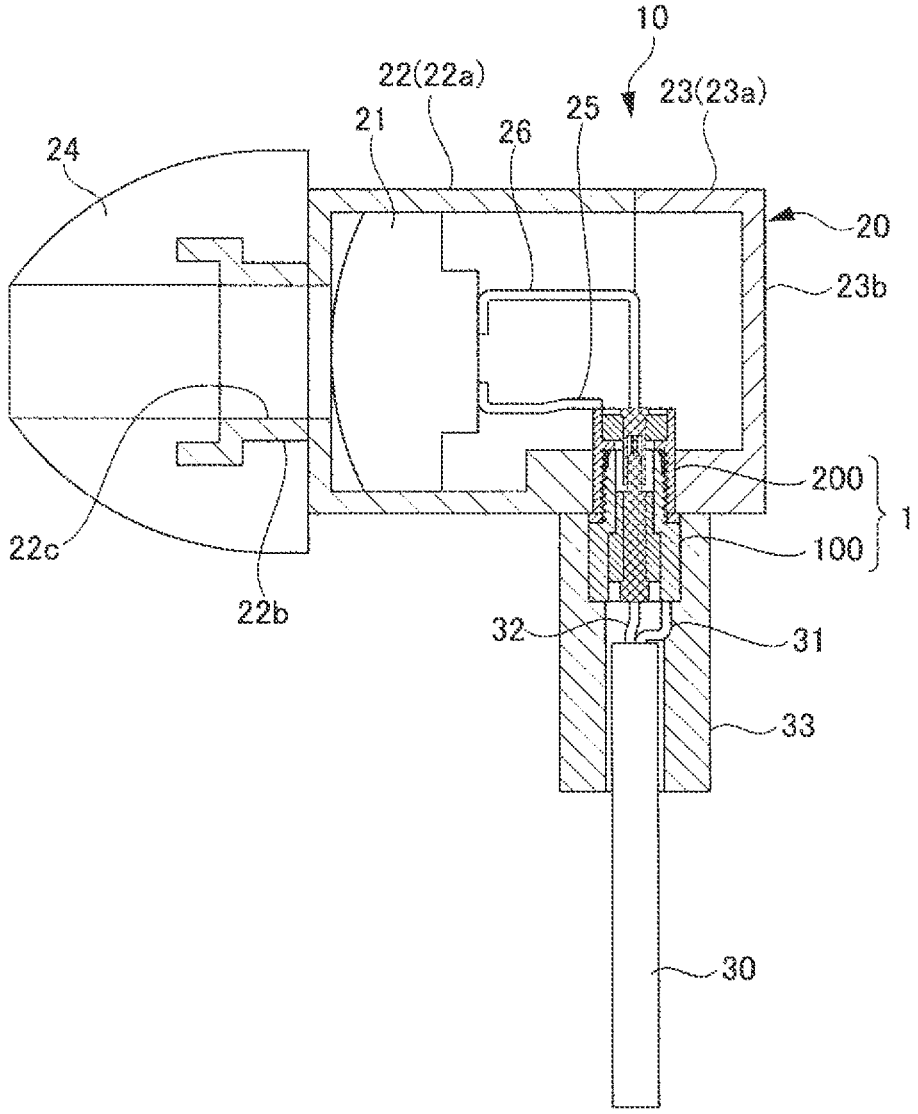
FIG. 7 is a cross-sectional view showing the earphone of the receiver in the first embodiment of the Present Disclosure connected to a cable, taken from Line A-A using a soldered connector.

The cable connector 100 shown in FIGS. 5-6 is a non-soldered connector that can be connected to the conductive wires 31, 32 of the cable 30 without using solder. However, the cable connector in FIG. 7 is a soldered connector which is soldered to the conductive wires 31, 32 of the cable 30.

Figure 8:
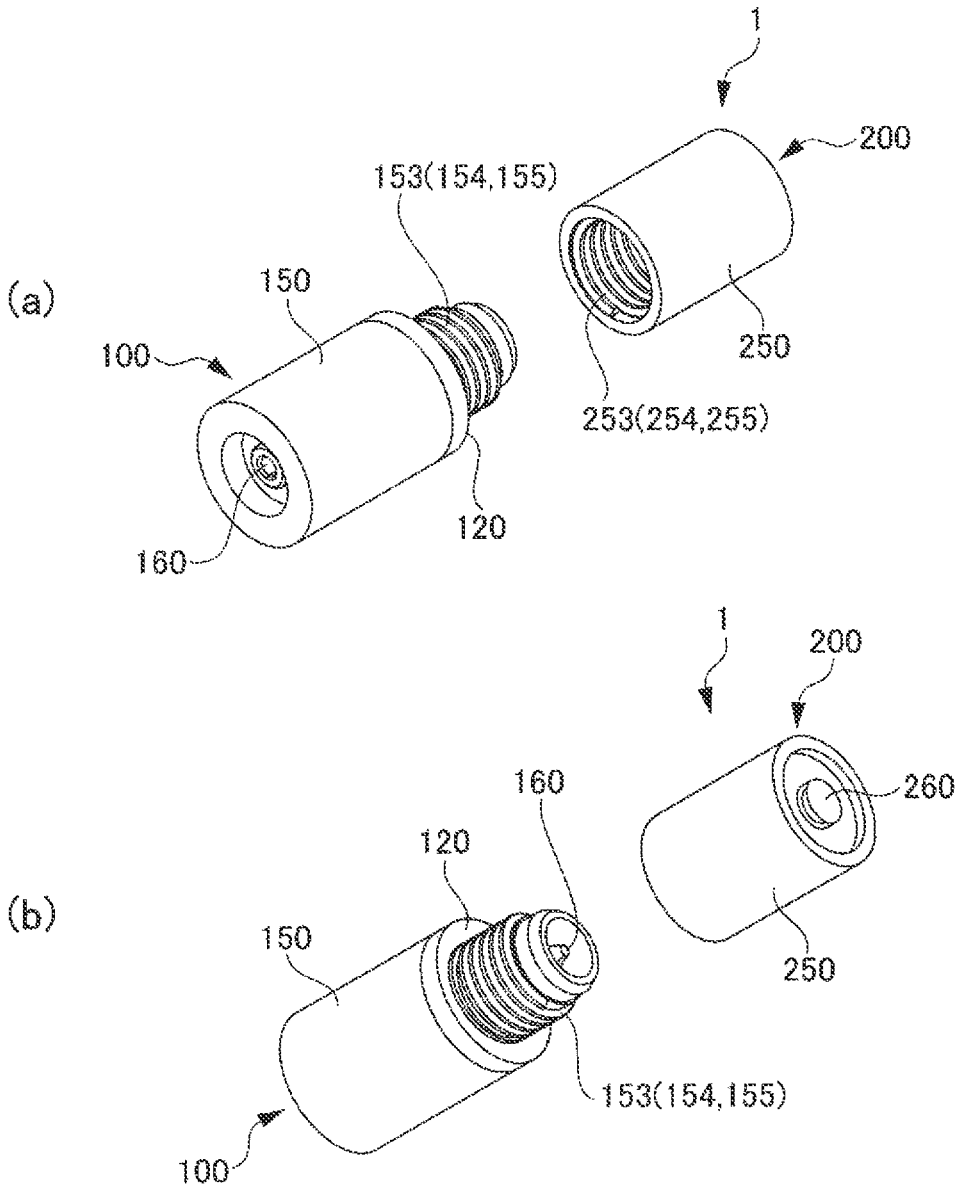
FIG. 8 is a diagram showing the earphone of the receiver in the first embodiment of the Present Disclosure detached from the cable; in which FIG. 8(*a*) is a rear perspective view showing a soldered connector, and FIG. 8(*b*) is a front perspective view showing a soldered connector.
Figure 9:
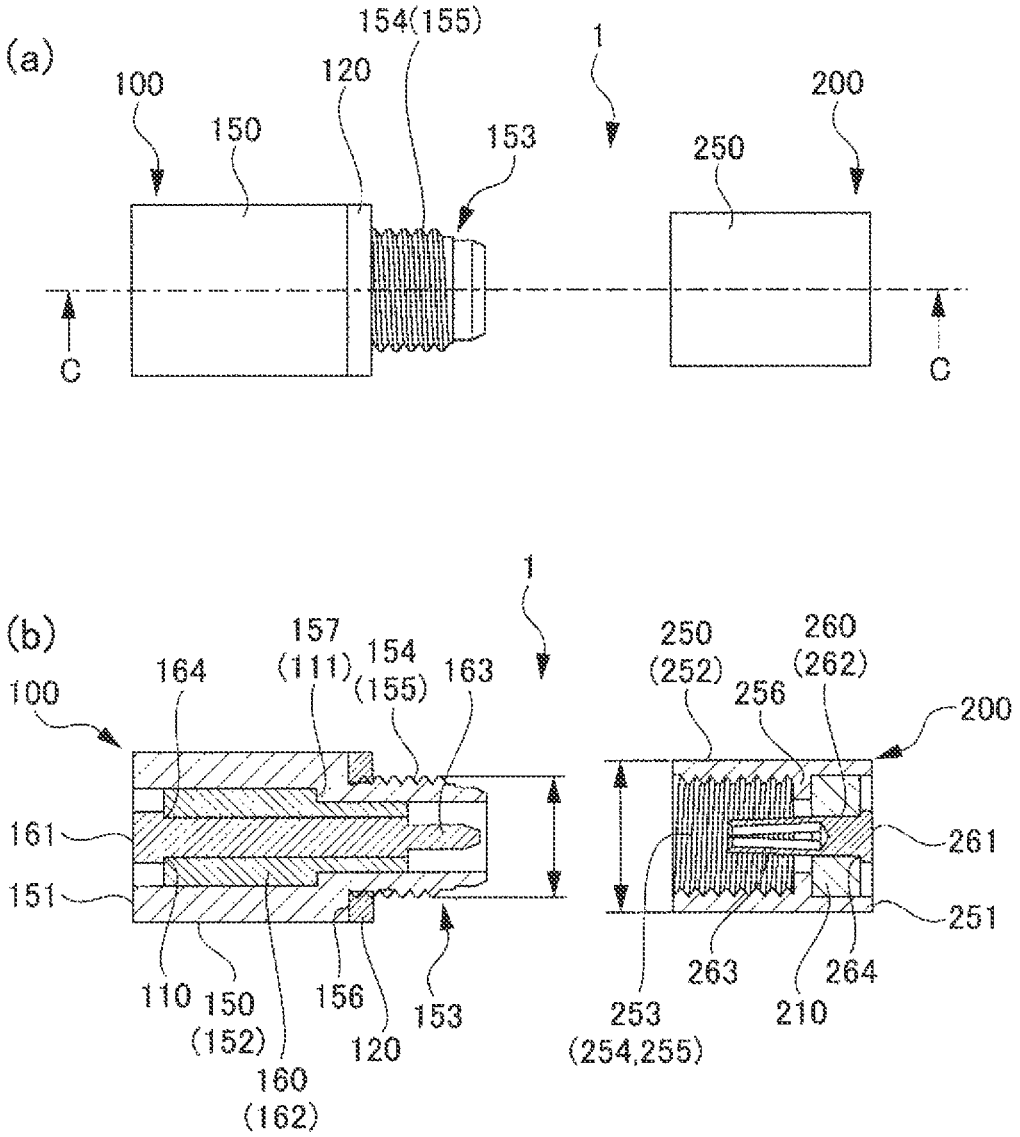
FIG. 9 is a diagram showing the earphone of the receiver in the first embodiment of the Present Disclosure detached from the cable, in which FIG. 9(*a*) is a side view showing a soldered connector, and FIG. 9(*b*) is a cross-sectional view from Line C-C showing a soldered connector.
Figure 10:
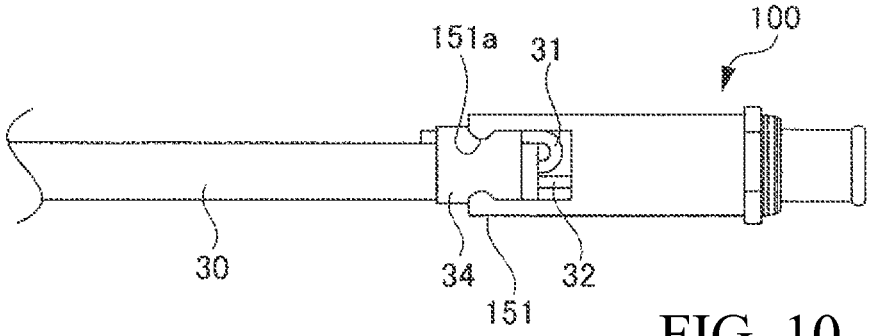
FIG. 10 is a side view showing the structure of the connection between a cable and the cable connector of the receiver in the first embodiment of the Present Disclosure (non-soldered connector)

The following is a more detailed explanation of the configuration of the connector 1 in the first embodiment of the Present Disclosure with reference to FIGS. 8-10. As shown in FIGS. 8-9, the connector 1 in the present embodiment is an ultra-small coaxial connector whose outer diameter fitted to the cable connector 100 may be 2 mm, and whose outer diameter fitted to the earbud connector 200 may be 2.5 mm.

The cable connector 100 includes an outer cable contact 150 made of a tube-shaped conductor, a tube-shaped cable-side insulator 110 arranged inside the outer cable contact 150, a pin-shaped inner cable contact 160 arranged inside the cable-side insulator 110, and a washer-shaped loose threading-preventing member 120 attached to the outer peripheral portion of the outer cable contact 150. The earbud connector 200 includes an outer earbud contact 250 made of a tube-shaped conductor, a tube-shaped earbud-side insulator 210 arranged inside the outer earbud contact 250, and a pin-shaped inner earbud contact 260 with a divided tip arranged inside the earbud-side insulator 210.

When the outer cable contact 150 and the outer earbud contact 250 are mated, the cable 100 connector and the earbud connector 200 form a coaxial connector in which the outer contacts 150, 250 and the inner contacts 160, 260 are connected electrically. The following is an explanation of each component of the cable connector 100 and the earbud connector 200. The outer cable contact 150 is made of a conductor with a cylindrical shape, and includes a connecting portion 151 connected to a conductive wire 31 in the cable 30, a fixed portion 152 fixed to the cover 33, a mating protrusion 153 mated with the outer earbud contact 250, and a contact portion 154 making contact with the outer earbud contact 250 during mating.

The connecting portion 151 is the rear end portion of the fixed portion 152, and the mating protrusion 153 is formed so as to protrude from the front end portion of the fixed portion 152. The mating protrusion 153 is mated on the inside of the outer earbud contact 250, and the outer peripheral surface forms a contact portion 154 which makes contact with the outer earbud contact 250. Threading grooves 155 are formed on the contact portion 154 enabling the outer earbud contact 250 to be screwed in.

Figure 12:
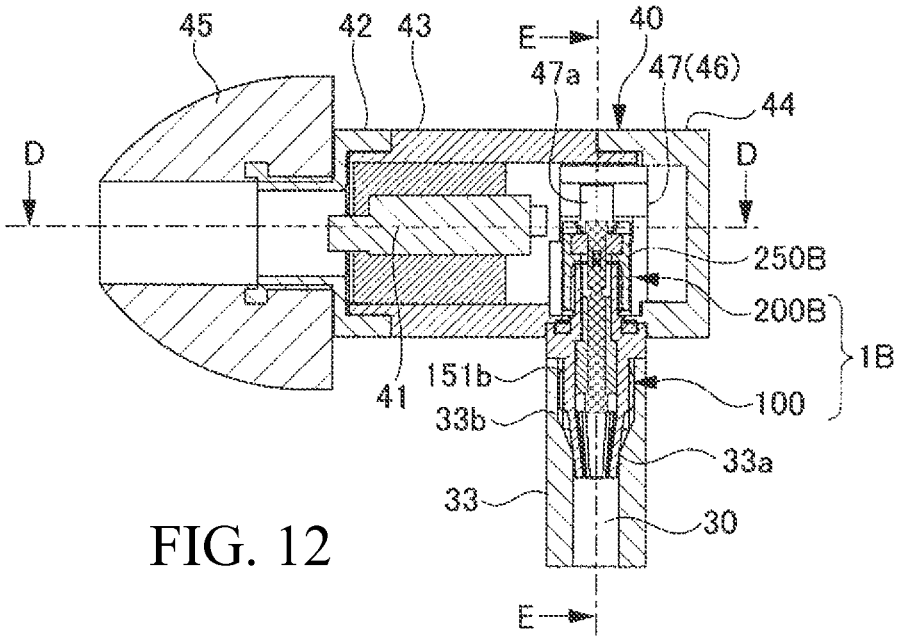
FIG. 12 is a cross-sectional view from Line A-A, showing the earphone of a receiver connected to a cable using the connector in the second embodiment of the Present Disclosure.

In the case of a non-soldered connector, as shown in FIG. 10, a connecting protrusion 151*a* is provided in the connecting portion 151 to serve as a correcting chuck for the outer cable contact 150. When a conductive wire 31 in the cable 30 is connected to the correcting chuck-type connecting portion 151, the conductive wire 31 is bent back towards the outer periphery of the cable 30, and copper foil tape 34 is wound on top of this so as to be interposed by the connecting protrusion 151*a* provided on the correcting chuck-type connecting portion 151. As shown in FIG. 12, the connecting portion 151 is forcibly pressed by an inclined portion 33*a* formed in the cover 33 shown in the second embodiment to push the connecting protrusion 151*a* into the copper foil tape 34. When the cable connector 100 has a non-soldered configuration, the soldering process can be eliminated, and a damaged cable can be easily replaced.

In the outer cable contact 150 of the present embodiment, the outer diameter of the mating protrusion 153 is smaller than that of the fixed portion 152, a tiered surface 156 is formed between the fixed portion 152 and the outer peripheral portion of the mating protrusion 153, and a washer-shaped loose threading-preventing member 120 is attached so as to come into contact with the tiered surface 156. There are no particular restrictions on the material from which the loose threading-preventing member 120 is made, but an elastic material that generates strong frictional force when compressed is preferred. A spring washer or washer with a chrysanthemum-shaped base having a loosening preventing effect can also be used.

The cable-side insulator 110 is made of an insulator with a cylindrical shape, and is forcibly inserted onto the rear opening of the outer cable contact 150. Tiered surfaces 157, 111 are formed in the inner peripheral portion of the outer cable contact 150 and in the cable-side insulator 110. The insertion position of the cable-side insulator 110 relative to the outer cable contact 150 is defined by the abutting tiered surfaces 157, 111.

The inner cable contact 160 is made of a pin-shaped conductor, and includes a connecting portion 161 connected to a conductive wire 32 in the cable 30, a fixed portion 162 fixed to the cable-side insulator 110, and a contact portion 163 making contact with the inner earbud contact 260. The connecting portion 161 is formed in the rear end of the fixed portion 162, and the contact portion 163 is formed so as to protrude from the front end of the fixed portion 162.

The inner cable contact 160 is forcibly inserted from the rear opening of the cable-side insulator 110. A tiered surface 164 is formed in the rear end of the inner cable contact 160, and the insertion position of the inner cable contact 160 relative to the cable-side insulator 110 is defined by the abutting tiered surface 164 and rear end surface of the cable-side insulator 110.

The outer earbud contact 250 is made of a conductor with a cylindrical shape, and includes a connecting portion 251 connected to a conductive wire 25 in the earbud 20, a fixed portion 252 fixed to the casings 22, 23 of the earbud 20, a mating recess 253 mated with the outer cable contact 150, and a contact portion 254 making contact with the outer cable contact 150 during mating.

The connecting portion 251 is the rear end portion of the fixed portion 252, and the mating recess 253 is the front inner peripheral portion of the fixed portion 252. The mating recess 253 is mated to the outside of the outer cable contact 150, and the inner peripheral surface forms the contact portion 254 which makes contact with the outer cable contact 150. Threading grooves 255 are formed on the contact portion 254 enabling the outer cable contact 150 to be screwed in.

The earbud-side insulator 210 is made of an insulator with a cylindrical shape, and is forcibly inserted from the rear opening of the outer earbud contact 250. A protruding portion 256 is formed in the inner peripheral portion of the outer earbud contact 250 to partition the insertion space of the earbud-side insulator 210 from the mating recess 253. The insertion position of the earbud-side insulator 210 relative to the outer earbud contact 250 is defined by the front end of the earbud-side insulator 210 abutting the protruding portion 256.

The inner earbud contact 260 is a pin-shaped conductor with a divided tip, and includes a connecting portion 261 connected to a conductive wire 26 in the earbud 20, a fixed portion 262 fixed to the earbud-side insulator 210, and a contact portion 263 making contact with the inner cable contact 160. The connecting portion 261 is formed in the rear end portion of the fixed portion 262, and the contact portion 263 is formed so as to protrude from the front end portion of the fixed portion 262.

The inner earbud contact 260 is forcibly inserted from the rear opening of the earbud-side insulator 210. A tiered surface 264 is formed in the rear end portion of the inner earbud contact 260, and the insertion position of the inner earbud contact 260 relative to the earbud-side insulator 210 is defined by the tiered surface 264 abutting the rear end surface of the earbud-side insulator 210.

The following is an explanation, with reference to FIGS. 5, 6 and 9, of the connection process performed using a connector 1 with the configuration described above. The connector 1 can be disconnected by performing the connection process in reverse.

The disconnected connector 1 shown in FIGS. 6 and 9 becomes the connected connector shown in FIG. 5 by taking the earbud 20 in one hand, and the cable connector 100 on the cable 30 in the other hand. Next, the outer cable contact 150 in the cable connector 100 is aligned with the outer earbud contact 250 in the earbud connector 200, and the mating protrusion 153 of the outer cable contact 150 is mated with the mating recess 253 of the outer earbud contact 250.

The mated outer contacts 150, 250 are then screwed in. More specifically, the cable connector 100 or the earbud connector 200 is rotated relative to the other, to screw the threading grooves 155 formed in the mating protrusion 153 of the outer cable contact 150 with the threading grooves 255 formed in the mating recess 253 of the outer earbud contact 250. The cable connector 100 and the earbud connector 200 are connected by screwing the outer contacts 150, 250 into each other. This keeps the connectors from being pulled apart in the longitudinal direction of the cable. The earbud 10 does not become disconnected even when the cable 30 is tugged during use.

When the outer contacts 150, 250 are screwed in and mated, the loose threading-preventing member 120 provided on the cable connector 100 is compressed between the outer contacts 150, 250. The compressed loose threading-preventing member 120 makes elastic contact with both mated outer contacts 150, 250, and generates frictional force between the outer contacts 150, 250. This keeps the mated threading from becoming loose.

The inner contacts 160, 260 become connected as the outer contacts 150, 250 are screwed in and mated. More specifically, the contact portion 163 of the inner cable contact 160 is divided by the pin-shaped contact portion 263 with the divided base in the inner earbud contact 260, the inner contacts 160, 260 make elastic contact with each other, and an electrical connection is established.

Figure 11:
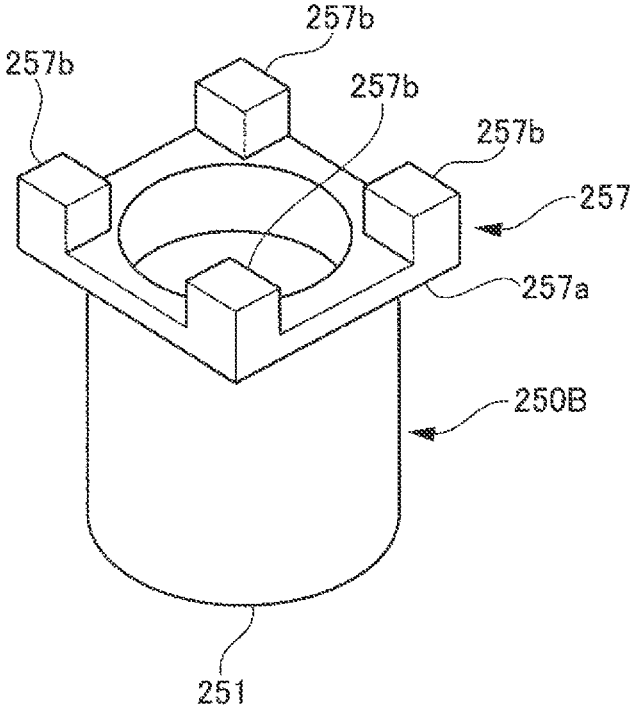
FIG. 11 is a perspective view showing the outer connector contact of the receiver in a second embodiment of the Present Disclosure.

The following is an explanation, with reference to FIG. 11 et seq., of the receiver in the second embodiment of the Present Disclosure and the connector 1B used by the receiver. Components identical to those in the previous embodiment are denoted by the same reference numbers, and further explanation of these components has been omitted.

As shown in FIG. 11, the connector 1B in the second embodiment of the Present Disclosure differs from the connector in the previous embodiment in that the outer earbud contact 250B includes an integrally formed rotation-preventing engagement portion 257 which engages the interior of the earbud 20 and prevents rotation of the outer earbud contact 250B. The rotation-preventing engagement portion 257 shown in FIG. 11 has a square flange portion 257*a* formed in the rear end portion (connecting portion 251) of the outer earbud contact 250B, and an engaging protrusion 257*b* protruding at each of the four corners of the flange portion 257*a*. When the engaging protrusions 257*b* are engaged inside the earbud 20, the outer earbud contacts 250B are kept from rotating.

When the outer contacts 150, 250B are screwed into each other and mated, the outer earbud contact 250B in the earphone connector 1B is subjected to rotational force, but the simple rotation-preventing structure reliably prevents rotation of the outer earbud contact 250B. The following is a more detailed explanation of the rotation-preventing structure of the outer earbud contact 250B.

The earbud 40 in the second embodiment, as shown in FIGS. 12-4, includes a driver unit 41 for converting electrical signals to sound, a front casing 42, middle casing 43 and rear casing 44 constituting the casing, an ear pad 45 inserted into the user's ear, and a pair of connector holding members 46, 47 for holding the earbud connector 200B. The driver unit 41 is housed inside the middle casing 43. The front end of the middle casing 43 is covered by the front casing 42, and the rear end of the middle casing 43 is covered by the rear casing 44. The earbud connector 200B is incorporated into the earbud 40 while held by the pair of connector holding members 46, 47, and interposed between the middle casing 43 and the rear casing 44.

Figure 13:
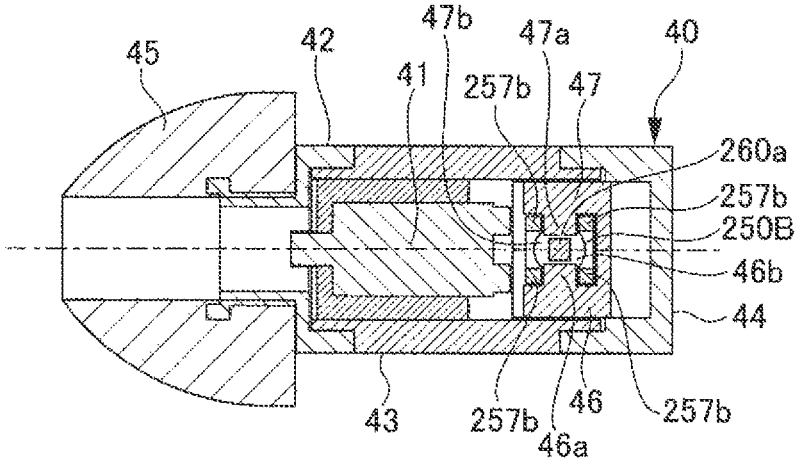
FIG. 13 is a cross-sectional view from Line D-D, showing the earphone of a receiver connected to a cable using the connector in the second embodiment of the Present Disclosure.
Figure 14:
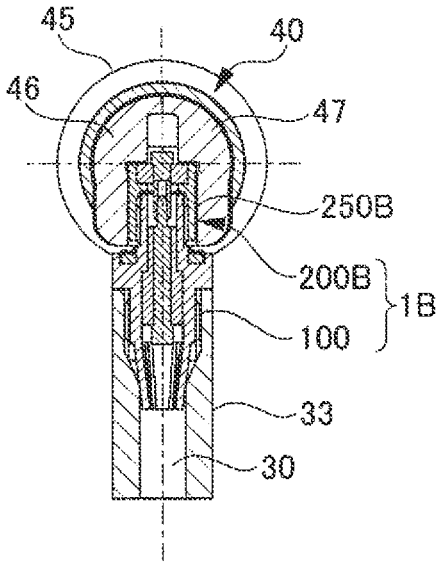
FIG. 14 is a cross-sectional view from Line E-E showing the earphone of a receiver connected to a cable using the connector in the second embodiment of the Present Disclosure.

The pair of connector holding members 46, 47 are left-right symmetric and, as shown in FIG. 14, interpose the earbud connector 200B from the left and right, engage the flange portion 257*a* of the outer earbud contact 250B, and hold the earbud connector 200B to keep it from being pulled out. Also, as shown in FIG. 13, the pair of connector holding members 46, 47 include engaging portions 46*a*, 47*a* for engaging the engaging protrusions 257*b* on the outer earbud contact 250B. The engaging portions 46*a*, 47*a* are inserted from the side between the engaging protrusions 257*b* formed at the four corners of the flange portion 257*a*, and hold the earbud connector 200B so as to keep it from rotating. The pair of connector holding members 46, 47 holding the earbud connector 200B so as to keep it from rotating are incorporated into the earbud 40 between the middle casing 43 and the rear casing 44. In the second embodiment, as shown in FIG. 13, the earbud end portion 260*a* of the inner earbud contact 260 in the earbud connector 200B protrudes in the shape of a square, and is interposed between the end surfaces 46*b*, 47*b* of the engaging portions 46*a*, 47*a*. Because the earbud end portion 260*a* is interposed between the end surfaces 46*b*, 47*b*, the inner earbud contact 260 can be kept from rotating when the cable connector 100 is screwed into the earbud connector 200B. Because of this simple rotation-preventing configuration, the outer earbud contact 250B and the inner earbud contact 260 can be easily kept from rotating relative to the earbud 40 and the connector 1 can be reliably joined simply by assembling the components. Also, in the second embodiment, an inclined portion 33*a* and a threaded portion 33*b* are formed in the cover 33, and a threaded portion 151*b* is formed in the outer peripheral surface of the connecting portion 151 of the outer cable contact 150. When the cover 33 is screwed in and attached to the cable connector 100, the inclined portion 33*b* presses the connecting protrusion 151*a* of the connecting portion 151 shown in FIG. 10 against the copper foil 34 to complete the correcting chuck connection.

While a preferred embodiment of the Present Disclosure is shown and described, it is envisioned that those skilled in the art may devise various modifications without departing from the spirit and scope of the foregoing Description and the appended Claims.

What is claimed is:

1. A receiver having a connector connected electrically to a receiver main body and to a cable, the connector comprising:

an outer main body contact composed of a tube-shaped conductor and provided on the main body side;

an inner main body contact arranged inside the outer main body contact via an insulator;

an outer cable contact composed of a tube-shaped conductor and provided on the cable side, and an inner cable contact arranged inside the outer cable contact via an insulator;

wherein the connector is mounted on the receiver main body so that, in response to the outer main body contact and outer cable contact being mated, a coaxial connector is formed electrically connecting the outer contacts and the inner contacts, the outer contacts being screwed into each other, and the outer main body contact not rotating relative to the receiver main body.

2. The receiver of claim 1, wherein the outer main body contact includes an outer contact rotation-preventing engagement portion for engaging the receiver main body and preventing rotation of the outer main body contact.

3. The receiver of claim 2, wherein the inner main body contact includes an inner contact rotation-preventing engagement portion for engaging the receiver main body and preventing rotation of the inner main body contact.

4. The receiver of claim 3, wherein the receiver main body includes a main body engaging portion for engaging the outer contact rotation-preventing engagement portion and the inner outer contact rotation-preventing engagement portion.

5. The receiver of claim 4, wherein the outer main body contact or the outer cable contact includes a washer-shaped loose threading preventing member applying pressure to both outer contacts in response to the outer contacts being screwed in.

6. The receiver of claim 1, wherein the outer main body contact or the outer cable contact includes a washer-shaped loose threading preventing member applying pressure to both outer contacts in response to the outer contacts being screwed in.

7. The receiver of claim 2, wherein the outer main body contact or the outer cable contact includes a washer-shaped loose threading preventing member applying pressure to both outer contacts in response to the outer contacts being screwed in.

8. The receiver of claim 3, wherein the outer main body contact or the outer cable contact includes a washer-shaped loose threading preventing member applying pressure to both outer contacts in response to the outer contacts being screwed in.

* * * * *